US009149701B1

(12) United States Patent
Bramlette

(10) Patent No.: US 9,149,701 B1
(45) Date of Patent: Oct. 6, 2015

(54) TRAINING BASKETBALL

(71) Applicant: Robin Bramlette, Austin, TX (US)

(72) Inventor: Robin Bramlette, Austin, TX (US)

( * ) Notice: Subject to any disclaimer, the term of this patent is extended or adjusted under 35 U.S.C. 154(b) by 0 days.

(21) Appl. No.: 13/834,981

(22) Filed: Mar. 15, 2013

(51) Int. Cl.
*A63B 43/00* (2006.01)
*A63B 69/00* (2006.01)

(52) U.S. Cl.
CPC ..... *A63B 69/0071* (2013.01); *A63B 2243/0037* (2013.01)

(58) Field of Classification Search
CPC ..... A63B 43/008; A63B 69/0071; A63B 2243/0037
USPC ..... 473/447, 595, 596, 597, 598, 603–605, 473/615, 570, 571; D21/712, 713
See application file for complete search history.

(56) References Cited

U.S. PATENT DOCUMENTS

| | | | | | |
|---|---|---|---|---|---|
| 1,664,257 | A | | 3/1928 | McCullough | |
| 1,931,303 | A | | 10/1933 | Sturgis | |
| 2,115,926 | A | * | 5/1938 | Hatton | 473/596 |
| 2,182,053 | A | * | 12/1939 | Reach | 473/597 |
| 2,325,128 | A | * | 7/1943 | Grady | 473/597 |
| 2,448,731 | A | * | 9/1948 | Arthur | 473/596 |
| 2,472,406 | A | | 6/1949 | Darula, Jr. | |
| 2,925,273 | A | * | 2/1960 | Pratt | 473/451 |
| 3,858,876 | A | * | 1/1975 | Williams | 473/450 |
| 4,128,238 | A | * | 12/1978 | Newcomb et al. | 473/451 |
| 4,345,759 | A | * | 8/1982 | Nims | 473/569 |
| 4,546,975 | A | | 10/1985 | Nims | |
| 4,874,169 | A | * | 10/1989 | Litchfield | 473/613 |
| 5,066,012 | A | * | 11/1991 | Stark | 473/570 |
| D329,674 | S | * | 9/1992 | Williams | D21/714 |
| 5,228,687 | A | * | 7/1993 | Luecke et al. | 473/596 |
| 5,236,383 | A | * | 8/1993 | Connelly | 446/219 |
| 5,269,514 | A | * | 12/1993 | Adler et al. | 473/596 |
| 5,407,193 | A | * | 4/1995 | McGinley | 473/451 |
| 5,451,046 | A | * | 9/1995 | Batton | 473/470 |
| D386,227 | S | * | 11/1997 | Hegenbarth et al. | D21/714 |
| D387,403 | S | * | 12/1997 | Hegenbarth et al. | D21/714 |
| 5,735,761 | A | * | 4/1998 | Palmquist | 473/596 |
| 6,012,997 | A | * | 1/2000 | Mason | 473/594 |
| 6,557,496 | B2 | * | 5/2003 | Herrenbruck | 119/707 |
| D485,316 | S | * | 1/2004 | Poegel, Jr. | D21/714 |
| D485,590 | S | * | 1/2004 | Poegel, Jr. | D21/714 |
| 6,722,889 | B1 | * | 4/2004 | Page et al. | 434/251 |
| 6,726,580 | B2 | * | 4/2004 | Peterson | 473/570 |
| 7,029,407 | B2 | * | 4/2006 | Lee et al. | 473/597 |
| 7,037,224 | B1 | * | 5/2006 | Page et al. | 473/596 |
| 7,041,015 | B2 | * | 5/2006 | Sowders | 473/422 |
| D537,132 | S | * | 2/2007 | Barhoum | D21/712 |
| D537,491 | S | * | 2/2007 | Pierce | D21/707 |
| 7,261,432 | B1 | * | 8/2007 | Habitz | 362/196 |
| D551,726 | S | * | 9/2007 | Pierce | D21/713 |
| D602,101 | S | * | 10/2009 | Thomas | D21/713 |
| 7,753,811 | B2 | * | 7/2010 | Mark | 473/422 |

(Continued)

OTHER PUBLICATIONS

"Densities of Miscellaneous Solids", The Engineering ToolBox, http://www.engineeringtoolbox.com/density-solids-d_1265.html, retrieved on Mar. 28, 2014, pp. 1-13.*

*Primary Examiner* — Steven Wong
(74) *Attorney, Agent, or Firm* — Johnson & Associates

(57) ABSTRACT

A basketball is disclosed that includes a plurality of indentations formed in the outer surface of the basketball, indicating where the hands of a shooter should be positioned. The indentations are formed with a material having a higher density that the surrounding material to keep the basketball balanced.

8 Claims, 5 Drawing Sheets

(56) References Cited

U.S. PATENT DOCUMENTS

| | | | | |
|---|---|---|---|---|
| 8,287,408 | B2 * | 10/2012 | Page et al. | 473/596 |
| 8,632,429 | B2 * | 1/2014 | Page et al. | 473/596 |
| 2004/0076938 | A1 * | 4/2004 | Publicover | 434/248 |
| 2005/0075197 | A1 * | 4/2005 | Horkan | 473/438 |
| 2005/0113195 | A1 * | 5/2005 | Carbonero | 473/596 |
| 2005/0119071 | A1 * | 6/2005 | Carbonero | 473/422 |
| 2006/0100041 | A1 * | 5/2006 | Page et al. | 473/447 |
| 2007/0049432 | A1 * | 3/2007 | Junior et al. | 473/596 |
| 2008/0113831 | A1 * | 5/2008 | Page et al. | 473/447 |
| 2008/0287230 | A1 * | 11/2008 | Guenther et al. | 473/596 |
| 2009/0325742 | A1 * | 12/2009 | Krysiak | 473/596 |

* cited by examiner

TRAINING BASKETBALL

FIELD

This disclosure relates to sports equipment. In particular, this disclosure is drawn to a basketball training aid.

BACKGROUND

When shooting a basketball, proper form is important. The proper form for shooting a basketball includes proper hand position. Improper hand position typically results in inaccurate shooting. In addition to proper form, the basketball itself can affect shooting accuracy. For example, a properly weighted and balanced basketball will be more accurate than an improperly or unbalanced ball.

SUMMARY

A training basketball is provided, including a hollow inflatable body having an outer surface, the outer surface being made from a first material having a first density, a plurality of indentations formed in the outer surface, the location of each of the plurality of indentations corresponding to a desired placement of a user's finger, wherein the plurality of indentations are formed from a second material having a second density, and wherein the second density is greater than the first density.

Another embodiment provides a method of balancing a sports ball having a plurality of tactile position indicators formed on the outer surface of the sports ball, the method including forming the tactile position indicators from a first material having a first density, and forming the remaining outer surface of the sports ball from a second material having a second density.

Other features and advantages of the present disclosure will be apparent from the accompanying drawings and from the detailed description that follows below.

BRIEF DESCRIPTION OF THE DRAWINGS

The present disclosure is illustrated by way of example and not limitation in the figures of the accompanying drawings, in which like references indicate similar elements and in which.

DETAILED DESCRIPTION

The present disclosure relates to a basketball training aid. As mentioned above, proper hand placement on a basketball is important, and results in more accurate shooting. When learning to shoot a basketball, children sometimes just grab a basketball with two hands and throw it toward the basket. The training basketball described below provides visual and tactile feedback to the shooter using indentations formed in the outer surface of the basketball at the proper location for each of the shooter's fingers. As a result, when a shooter holds the basketball, the shooter can see and feel the proper placement of both hands.

Figure 1:
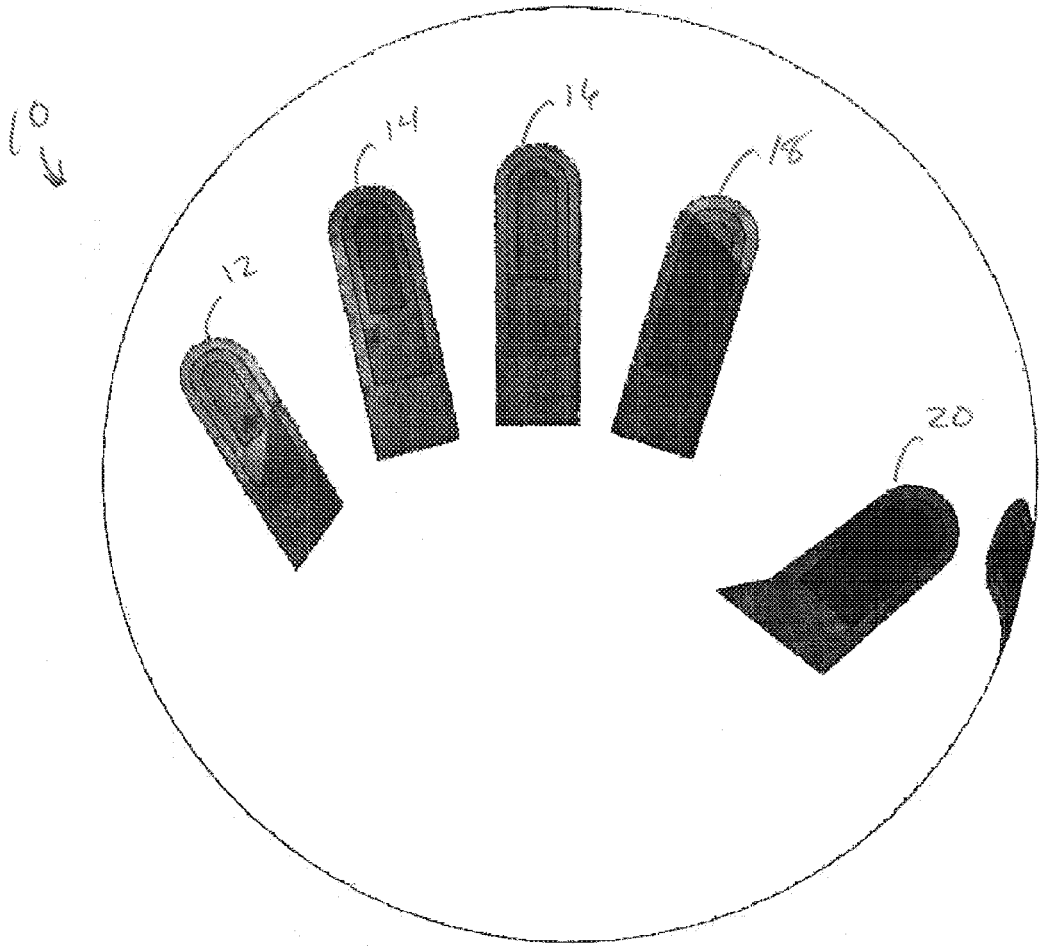
FIG. 1 is a side view of a training basketball, showing the proper placement of the left hand of a shooter.

In one example, an indentation is formed at ten locations of a basketball, each corresponding to the proper placement of one of the shooter's fingers. FIGS. 1-4 are views of a training basketball having indentations corresponding to proper locations for both hands of a shooter. FIG. 1 is a side view of a basketball 10, showing the proper placement of the left hand of a right handed shooter. The basketball 10 is a spherical hollow inflatable body having an outer surface. Indentations 12, 14, 16, 18 are located at the ideal locations for the shooter's left hand fingers. Indentation 20 is located at the ideal location for the shooter's left hand thumb. In one example, the indentations are deepest at the point where the respective finger should be applying the most pressure.

Figure 2:
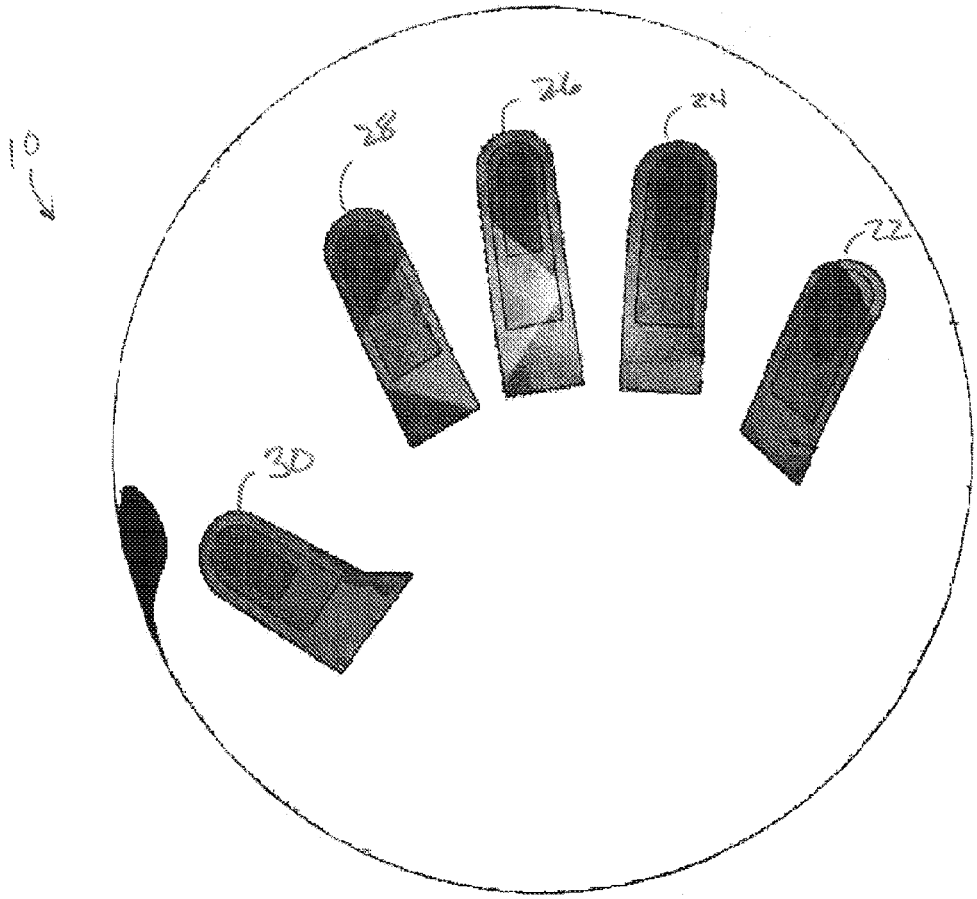
FIG. 2 is a side view of a training basketball, showing the proper placement of the right hand of a shooter.

FIG. 2 is a side view of a basketball 10, showing the proper placement of the right hand of a right handed shooter. Indentations 22, 24, 26, 28 are located at the ideal locations for the shooter's right hand fingers. Indentation 30 is located at the ideal location for the shooter's right hand thumb.

Figure 3:
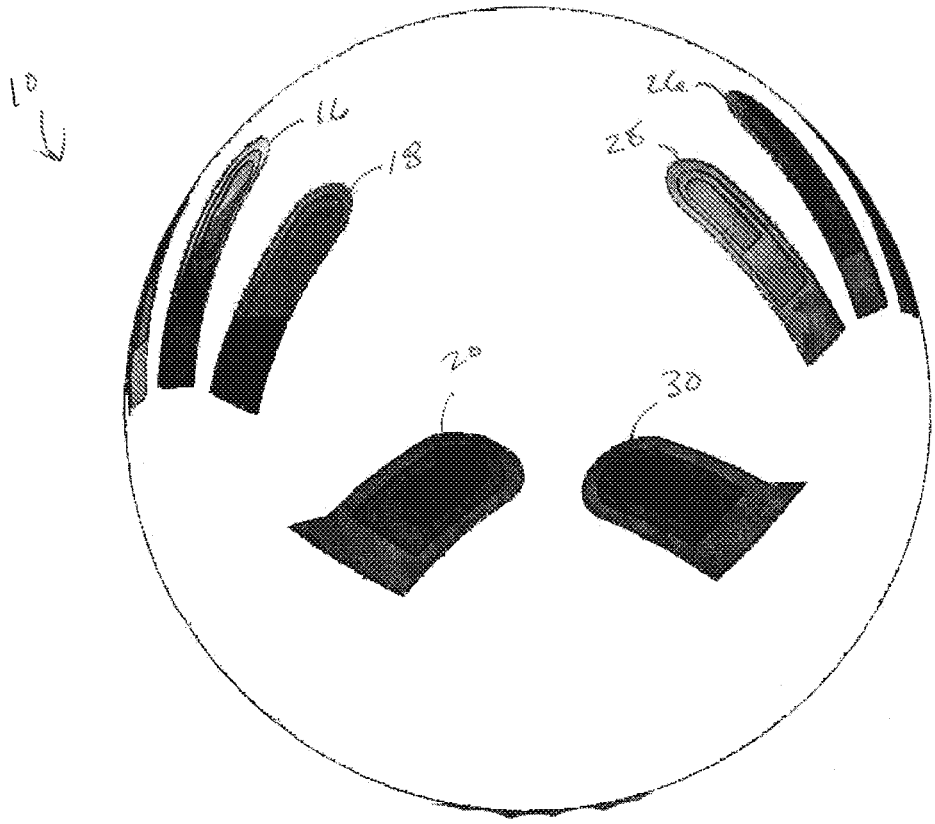
FIG. 3 is a side view of a training basketball, showing the relative placement of a shooter's hands.
Figure 4:
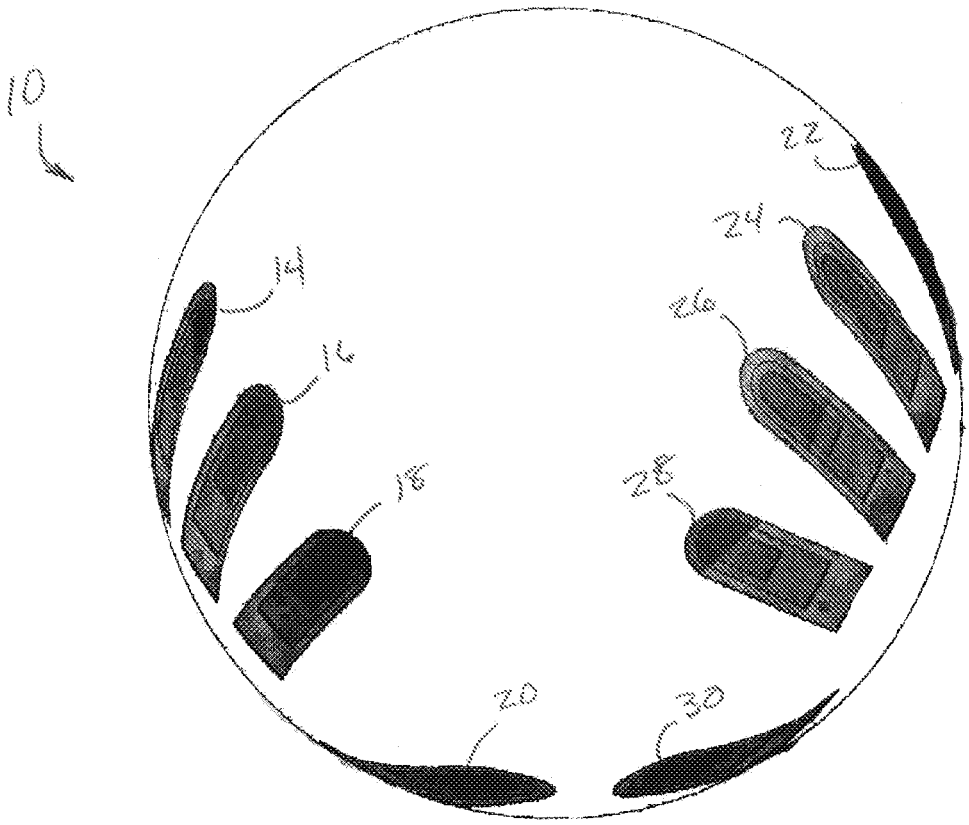
FIG. 4 is a top view of a training basketball, showing the relative placement of a shooter's hands.

FIG. 3 is a side view of the basketball 10, showing the relative placement of a shooter's hands when using the indentations. FIG. 4 is a top view of the basketball 10, also showing the relative placement of a shooter's hands when using the indentations.

Figure 5:
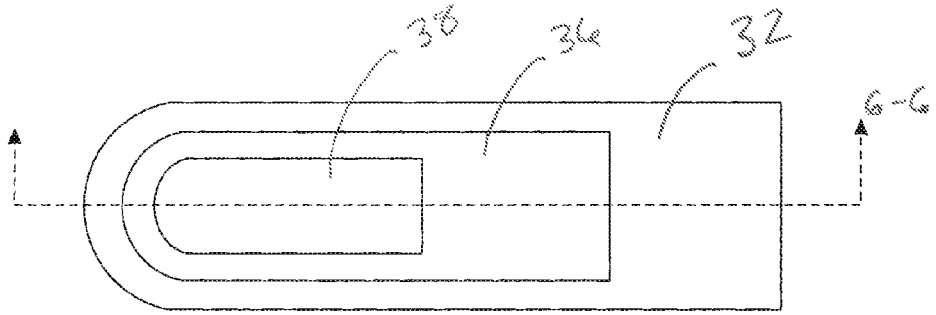
FIG. 5 is an enlarged top view of one of the indentations shown in FIGS. 1-4.
Figure 6:
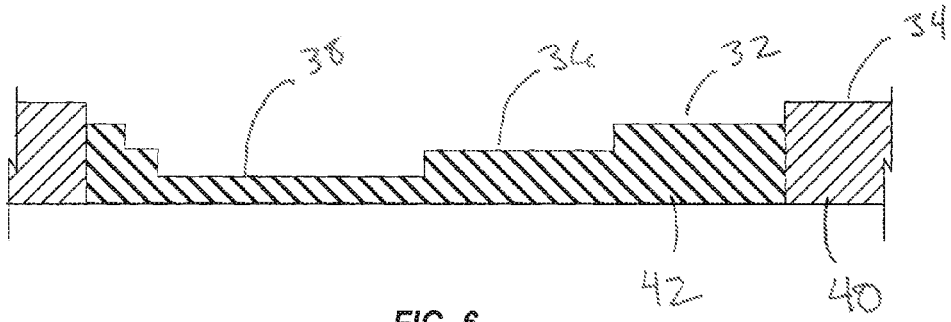
FIG. 6 is a sectional view of one of the indentations shown in FIGS. 1-4.

In the examples shown in the figures, the indentations are generally shaped like the end of a user's fingers, and are deepest where the most pressure should be applied. FIG. 5 is an enlarged top view of one of the indentations shown in FIGS. 1-4. FIG. 6 is a sectional view of the indentation taken along line 6-6 of FIG. 5, and also shows a portion of the surrounding ball surface material. In this example, the depth of each indentation is formed in a stair-stepped manner. For clarity, the sectional view of FIG. 6 is shown with the basketball material laid flat, rather than curved, as it would be when the basketball is inflated. Only the outer surface of the ball is shown. A complete ball may also include a bladder and other components. Also note that FIGS. 5 and 6 are not drawn to scale.

As shown in FIGS. 5 and 6, a first relatively shallow indentation layer 32 is formed slightly below the outer surface 34 of the basketball 10. A second indentation layer 36 is formed within the periphery of the first indentation layer 32, and is slightly deeper than the indentation layer 32. A third indentation layer 38 is formed within the periphery of the second indentation layer 36, and is the deepest of the indentation layers. In one example, the deepest indentation (in this example, layer 38) is approximately 2 mm below the outer surface 34 of the basketball 10. The depth of the indentations can be more or less, as desired. In addition, the indentations can be formed with smooth uniform transitions, rather than in the stair-stepped manner shown.

As mentioned above, an imbalanced basketball can affect the accuracy of a shooter. Therefore, when manufacturing basketballs, it is important ensure the proper balance. In the examples shown in FIGS. 1-6, the indentations would cause a basketball to be unbalanced, since less material is used where the indentations are formed. One solution is illustrated in FIG. 6. Typically, the material used on the outer surface of a basketball (e.g., rubber, leather, etc.) is uniform around the basketball. In this example, a denser material is used in the locations of the indentations, to compensate for the weight of the material that would have been disposed in the indentations. As shown in FIG. 6, the basketball 10 is made from material 40, which could be rubber (natural or synthetic), leather, etc. In the location of the indentations, material 42 is used. Material 42 has a higher density than material 40, to help compensate for the weight that would have been lost from forming the indentations in material 40. The material 42 can be any desired material. For example, if the basketball is a rubber basketball, material 42 can also be rubber, but is a type of rubber that has a higher density the rubber used as material 40.

A basketball having indentations can be balanced on other ways as well. For example, a basketball could be balanced by removing material (to reduce weight) from strategic locations on the basketball, or adding material at locations to increase the weight. In another example, a weight could be added to the inside surface of the basketball at the location of each indentation, to compensate for the material removed to form the indentations. Other examples are also possible.

In the preceding detailed description, the disclosure is described with reference to specific exemplary embodiments thereof. Various modifications and changes may be made thereto without departing from the broader spirit and scope of the disclosure as set forth in the claims. The specification and drawings are, accordingly, to be regarded in an illustrative rather than a restrictive sense.

What is claimed is:

1. A training basketball comprising:

a hollow inflatable body having an outer surface, the outer surface being made from a first material having a first density;

a plurality of indentations having a tiered depth formed in the outer surface, the location of each of the plurality of indentations corresponding to a desired placement of a user's finger, wherein the indentations further comprise a plurality of indentation layers each having a different depth relative to the outer surface;

wherein the plurality of indentations are formed from a second material having a second density, and wherein the second density is greater than the first density.

2. The training basketball of claim 1, wherein the deepest portion of each indentation correspond to a desired finger location.

3. The training basketball of claim 1, wherein the first and second materials are rubber materials.

4. The training basketball of claim 3, wherein the first and second materials are synthetic rubber.

5. The training basketball of claim 1, wherein the first material is leather.

6. The training basketball of claim 1, wherein the second material is rubber.

7. A method of balancing a sports ball having a plurality of tactile position indicators formed on the outer surface of the sports ball, the method comprising:

forming the tactile position indicators from a first material having a first density, wherein the tactile position indicators have a tiered depth, and wherein the tactile position indicators further comprise a plurality of indentation layers each having a different depth relative to the outer surface of the sports ball; and forming the remaining outer surface of the sports ball from a second material having a second density.

8. The method of claim 7, wherein the first density is greater than the second density.

* * * * *